US009441381B2

(12) United States Patent
Hatch et al.

(10) Patent No.: US 9,441,381 B2
(45) Date of Patent: Sep. 13, 2016

(54) CONSTRUCTION ELEMENT

(71) Applicants: William Michael Hatch, Peoria, AZ (US); Phil De La O, Jr., Glendale, AZ (US)

(72) Inventors: William Michael Hatch, Peoria, AZ (US); Phil De La O, Jr., Glendale, AZ (US)

(73) Assignee: Stainless Architectural Supply, LLC, Peoria, AZ (US)

( * ) Notice: Subject to any disclaimer, the term of this patent is extended or adjusted under 35 U.S.C. 154(b) by 0 days.

(21) Appl. No.: 14/313,991

(22) Filed: Jun. 24, 2014

(65) Prior Publication Data

US 2015/0368913 A1 Dec. 24, 2015

(51) Int. Cl.

| | |
|---|---|
| ***E04F 13/072*** | (2006.01) |
| ***E04F 13/08*** | (2006.01) |
| ***E04F 19/02*** | (2006.01) |
| ***E04F 19/04*** | (2006.01) |
| *B21D 5/16* | (2006.01) |
| *E04F 13/07* | (2006.01) |

(52) U.S. Cl.

CPC ..... *E04F 19/02* (2013.01); *E04F 19/022* (2013.01); *E04F 19/0436* (2013.01); *B21D 5/16* (2013.01); *E04F 13/07* (2013.01); *E04F 13/072* (2013.01); *E04F 2019/0413* (2013.01)

(58) Field of Classification Search

CPC ..... E04F 13/00; E04F 13/002; E04F 13/07; E04F 13/072; E04F 13/08; E04F 13/0835; E04F 13/0887; E04F 13/26

USPC ..... 52/97, 287.1, 288.1, 62, 58

See application file for complete search history.

(56) References Cited

U.S. PATENT DOCUMENTS

| | | | | |
|---|---|---|---|---|
| 3,158,960 | A * | 12/1964 | Newton et al. | 52/302.1 |
| 3,188,772 | A | 6/1965 | Tennison, Jr. | |
| 3,237,352 | A * | 3/1966 | Edwards | 52/60 |
| 3,242,622 | A * | 3/1966 | Snead | 52/94 |
| 3,735,538 | A * | 5/1973 | Ramins | 52/94 |
| 4,663,906 | A | 5/1987 | Weinar | |
| 4,809,479 | A * | 3/1989 | Tierno | E04F 13/0864 211/189 |
| 4,825,601 | A * | 5/1989 | Halverson | A47F 5/0846 211/189 |
| 5,090,174 | A | 2/1992 | Fragale | |
| 5,426,898 | A * | 6/1995 | Larsen | E04D 3/40 428/152 |

(Continued)

FOREIGN PATENT DOCUMENTS

| | | |
|---|---|---|
| CN | 202915027 U | 5/2013 |
| JP | 4611133 | 1/2011 |
| WO | 9410404 | 5/1994 |

*Primary Examiner* — Phi A

(74) *Attorney, Agent, or Firm* — Bryan Cave LLP

(57) ABSTRACT

A generally stainless steel construction element, such as baseboard trim, crown molding, or wainscoting, comprises a span of continuous sheet material having a leading top edge folded back upon itself in a fashion to form an integrated leading top edge groove to accept an edge of a first planar material, such as a wall board, within the leading top edge groove. The construction element may further comprise a leading bottom edge folded back upon itself in a fashion to form an integrated leading bottom edge groove to accept an edge of a second planar material, such as flooring, within the leading bottom edge groove. In an embodiment, the construction element, the first planar material, and the second planar material assemble to comprise a continuous surface barrier. The construction element may alternately comprise one of the leading edges to be folded back upon itself in a bull nosed fashion.

19 Claims, 14 Drawing Sheets

(56) References Cited

U.S. PATENT DOCUMENTS

| | | | | |
|---|---|---|---|---|
| 5,560,170 | A * | 10/1996 | Ganser | E04F 19/024 52/212 |
| 5,819,490 | A * | 10/1998 | Current | A47F 5/0846 211/94.01 |
| 5,836,113 | A | 11/1998 | Bachman | |
| 5,944,203 | A * | 8/1999 | Vlah | A47F 5/0846 211/189 |
| 6,186,605 | B1 * | 2/2001 | Nelson | 312/140.4 |
| D443,073 | S | 5/2001 | Wilson | |
| D489,832 | S | 5/2004 | Koenig, Jr. | |
| 6,802,161 | B1 * | 10/2004 | Robinson | 52/287.1 |
| D528,669 | S | 9/2006 | Zarb | |
| D599,916 | S | 9/2009 | Polston | |
| 7,823,336 | B2 * | 11/2010 | Brochu et al. | 52/60 |
| 8,468,767 | B1 | 6/2013 | McBride | |
| 8,495,844 | B1 | 7/2013 | Johnson, Sr. | |
| 2001/0039774 | A1 * | 11/2001 | Beirise et al. | 52/287.1 |
| 2003/0037495 | A1 * | 2/2003 | Shaw | E04F 19/022 52/287.1 |
| 2003/0121217 | A1 * | 7/2003 | Grizenko | E04D 3/40 52/60 |
| 2003/0213195 | A1 * | 11/2003 | Mathis et al. | 52/287.1 |
| 2005/0257443 | A1 * | 11/2005 | Lin | 52/97 |
| 2007/0199269 | A1 | 8/2007 | Mees | |
| 2008/0005986 | A1 | 1/2008 | Thompson | |
| 2008/0295439 | A1 | 12/2008 | Janesky | |
| 2009/0056252 | A1 | 3/2009 | Taylor | |
| 2009/0139167 | A1 | 6/2009 | Donaldson | |
| 2011/0179733 | A1 * | 7/2011 | Picken | E04F 19/02 52/242 |
| 2012/0102849 | A1 * | 5/2012 | Shugart | 52/96 |
| 2013/0255171 | A1 * | 10/2013 | Rutherford | 52/287.1 |

* cited by examiner

CONSTRUCTION ELEMENT

BACKGROUND OF THE INVENTION

In a construction environment, it is often desirous for aesthetic and functional purpose to protect an underlying bare surface, such as a wall or floor, from dirt, grime, grease, bacteria, animals, and any other deleterious elements. For example, in a commercial environment such as a; restaurant, cafeteria, food stand, etc., finishing items are generally installed over a bare surface to create a finished or working surface. Generally, such finishing items cover and treat bare surfaces using various wall board, sheet rock, plaster, backsplashes, tile, wallpaper, carpeting, wood, paneling, vinyl, etc.

With the installation of these finishing items, it is typical to install construction trim elements, like baseboards, crown molding, wainscoting, etc., to cover or seal a transition from one finishing item to the other. Such construction trim elements have inherent flaws that allow or promote the above mentioned deleterious elements. For example, almost all of these construction trim elements are installed using nails, staples, glues, caulks and the like that are ineffective to completely seal the finishing items. Moreover, such trim elements may degrade, peel, warp, etc., by using standard securing techniques. What is needed is a construction trim element that can operate to seal and/or operate as a transition from one surface finishing item to another, and prevent any of the fore mentioned deleterious materials from contacting the underlying base surfaces.

SUMMARY OF THE INVENTION

Among various representative embodiments, a construction (trim) element may comprise a span of continuous sheet material, generally stainless steel, having a leading top edge folded back upon itself in a fashion to form an integrated leading top edge groove to accept an edge of a first planar material within the leading top edge groove. The construction element may further comprise a leading bottom edge folded back upon itself in a fashion to form an integrated leading bottom edge groove to accept an edge of a second planar material within the leading bottom edge groove. In an embodiment; the construction element, the first planar material, and the second planar material assemble to comprise a continuous barrier for a bare or base surface, such as a wall, floor, or both.

Among various representative embodiments, the span of continuous sheet material may be dimensioned to operate as at least one of a baseboard construction element, a crown molding construction element, a wainscoting construction element, or any other construction element now known or developed in the future. Representative embodiments may comprise a leading top edge groove and a leading bottom edge groove to be substantially co-planar, substantially normal to one another, or comprise any other variable acute or obtuse angles between them. Some representative embodiments may comprise a construction element to comprise one or more mid-body grooves and/or breaks to support large spans of sheet material from flexing and/or to provide a groove to support other attaching elements.

Among other representative embodiments, a construction element may comprise a span of continuous sheet material having a first edge portion folded back upon itself in an "S" shaped pattern to form an integrated first edge portion groove to accept an edge of a planar material within the first edge portion groove. The construction element may also comprise a leading second edge portion, opposite the first edge portion, folded back upon itself to form a bull nosed configuration.

Among various representative embodiments, methods of the construction element may comprise a method for manufacturing, packaging, marketing, distributing, and/or selling the construction element.

BRIEF DESCRIPTION OF THE DRAWINGS

A more complete understanding of a construction element may be derived by referring to the detailed description and claims when considered in connection with the following illustrative Figs. In the following Figs., like reference numbers refer to similar elements and steps throughout the Figs.

Elements and/or any steps among the Figs. are illustrated for simplicity and clarity and have not necessarily been rendered according to any particular sequence. For example, steps that may be performed concurrently or in different order may be illustrated in the Figs. to help to improve understanding of embodiments of the construction element. Moreover, elements may be constructed in various combinations and/or permutations.

DETAILED DESCRIPTION OF THE INVENTION

A construction element may be described herein by terms of various functional elements and various method steps. Such functional elements may be realized by any number of hardware components adapted to perform generalized or specific functions to achieve various results. For example, the construction element may employ various construction element components, e.g., various materials, such as stainless steel, standard steel grades, aluminum, copper, various alloy combinations, vinyl, and any other natural and/or synthetic materials whether now known or developed in the future. Moreover, the construction element may comprise various structural configurations, for example, tongue and grooves, slots, laps, welds, snaps, latches, wells, and the like, which may carry out a variety of functions. And each structural configuration may comprise any number or permutations of configurations, for example, various scale, gauge, finish, size, geometry, surface texture, and the like may be employed.

Those skilled in the art will understand that the construction element may be practiced as part of any variety of construction element and/or finishing applications, whether for commercial, industrial, and/or residential, purpose; and any particular system, method, and/or purpose described is merely exemplary for the construction element. Those skilled in the art will further understand that the construction element may be practiced by any number of other applications and environments, whether now known or developed in the future. Finally, those skilled in the art will understand that the construction element may employ any number of conventional techniques for manufacturing, installing, packaging, marketing, distributing, and/or selling the construction element.

Figure 1:
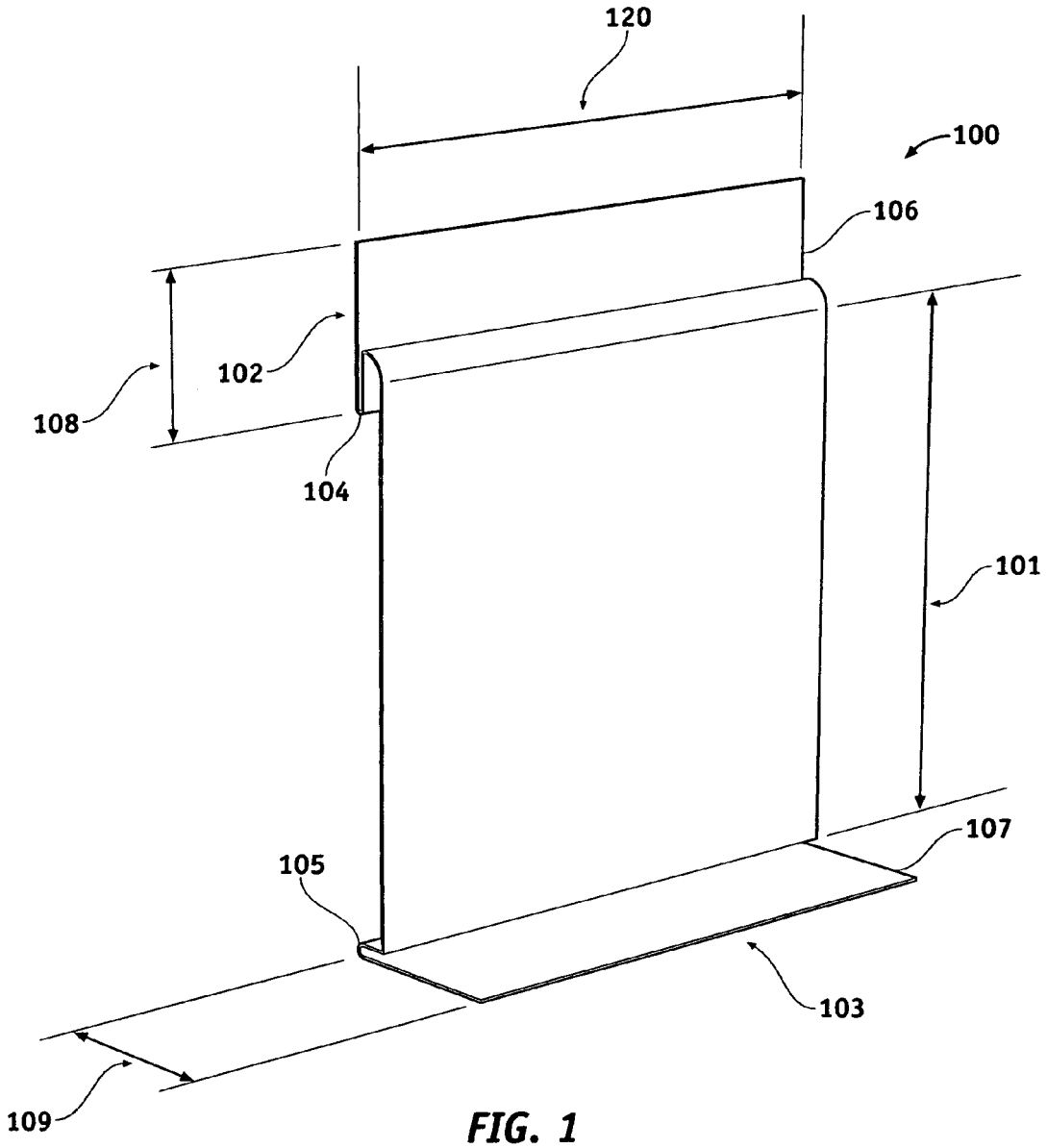
FIG. 1 representatively illustrates an exemplary embodiment of a construction element.

Various representative implementations of the construction element may be applied to any construction system. Referring now to FIG. 1, an exemplary embodiment of a construction element 100 may comprise a span 101 of continuous sheet material comprising a leading top edge 102 folded back upon itself in a fashion to form an integrated leading top edge groove 104. Construction element 100 may further comprise a leading bottom edge 103 folded back upon itself in a fashion to form an integrated leading bottom edge groove 105. Among various exemplary embodiments, spans, such as span 101, may comprise any dimensional length depending on the purpose for which the construction element may be used. For example, if construction element 100 were configured for use as a baseboard trim or crown molding application, span 101 may comprise a rather limited span dimension of a few inches. Whereas, if construction element 100 were configured for use as a wainscoting, backsplash or other larger application, then span 101 may comprise a span dimension of several inches, and possibly several feet.

Among various exemplary embodiments, those skilled in the art will understand that construction elements disclosed herein may comprise various materials, preferably stainless steel, but other materials such as, standard steel grades, aluminum, copper, various alloy combinations, vinyl, and any other natural and/or synthetic materials whether now known or developed in the future, may likewise be used.

Figure 2:
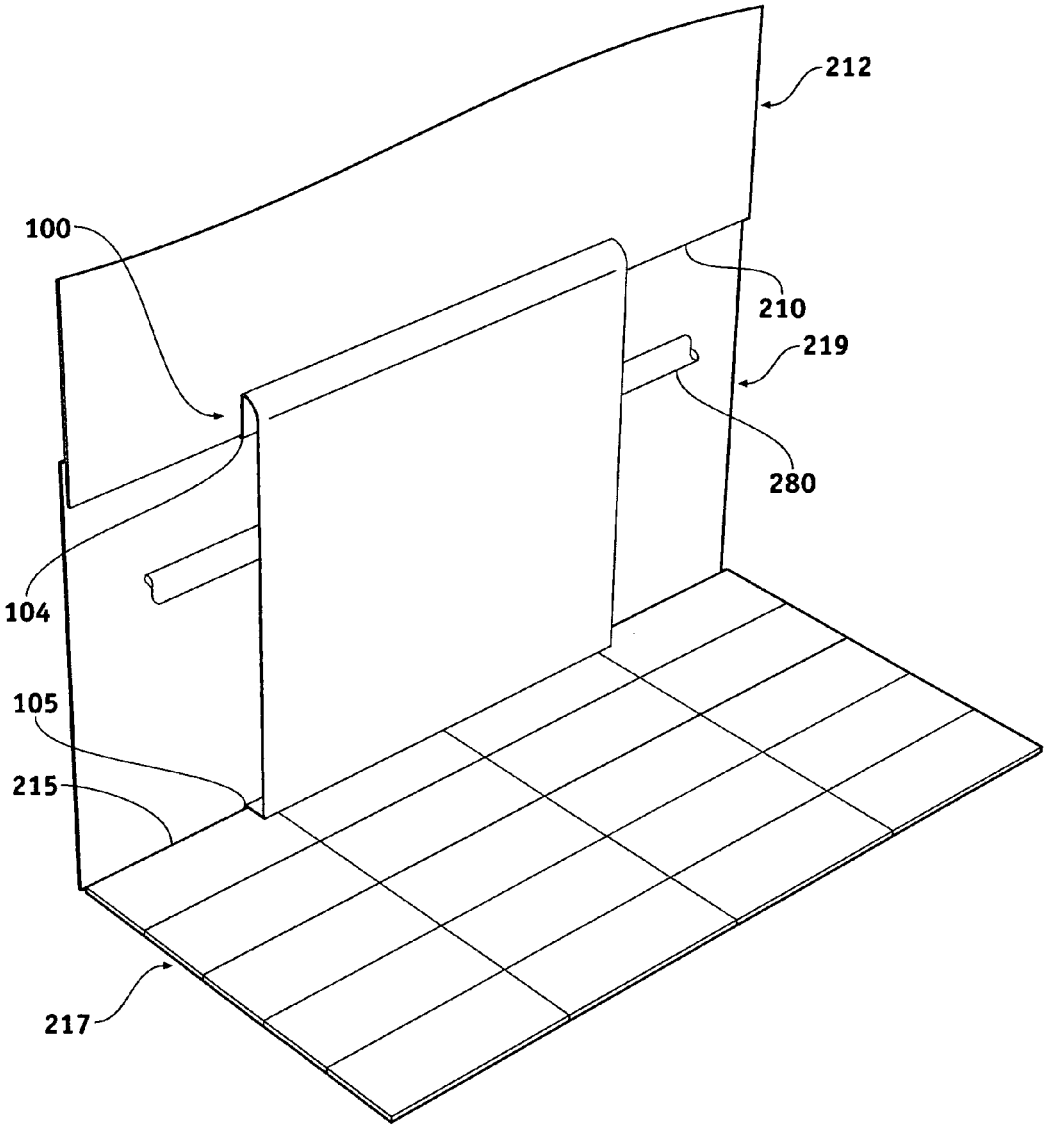
FIG. 2 representatively illustrates the exemplary embodiment of the construction element as used in a particular environment.

Turning now to FIG. 2, among various exemplary embodiments, construction element 100, comprising leading top edge groove 104, may be adapted to accept an edge 210 of a first planar material 212 within leading top edge groove 104. Similarly, leading bottom edge groove 105 may be adapted to accept an edge 215 of a second planar material 217 within leading bottom edge groove 105. In an embodiment; construction element 100, first planar material 212, and second planar material 217 may assemble to comprise a continuous barrier for a surface, such as a surface 219, which may comprise a wall, a floor, a corner, a post, etc. Among various exemplary embodiments, any first planar materials and/or any second planar materials may be secured within their respective grooves by any now known or future developed technology. For example, first planar material 212 and/or second planar material 217 may be secured within respective grooves 104 and 105 preferably by friction fits, but glues, welds, caulks, rivets, screws, bolts, and any other securing mechanisms now known or developed in the future may be used. Moreover, construction element 100 may be secured to the base surface, such as surface 219, using various securing mechanisms, such as caulks, glues, foams, rivets, nails, clamps, epoxies, and the like, or the construction element may be free floating.

Those skilled in the art will understand that among various exemplary embodiments, construction elements may comprise grooves having dimensions to accommodate planar materials, such as first planar material 212 and second planar material 217, so that the planar materials fit securely within the grooves. For example, if first planar material 212 comprised a dimensional thickness of a few millimeters, then groove 104 would comprise a similar width such that first planar material 212 would fit tightly within groove 104.

Figure 3:
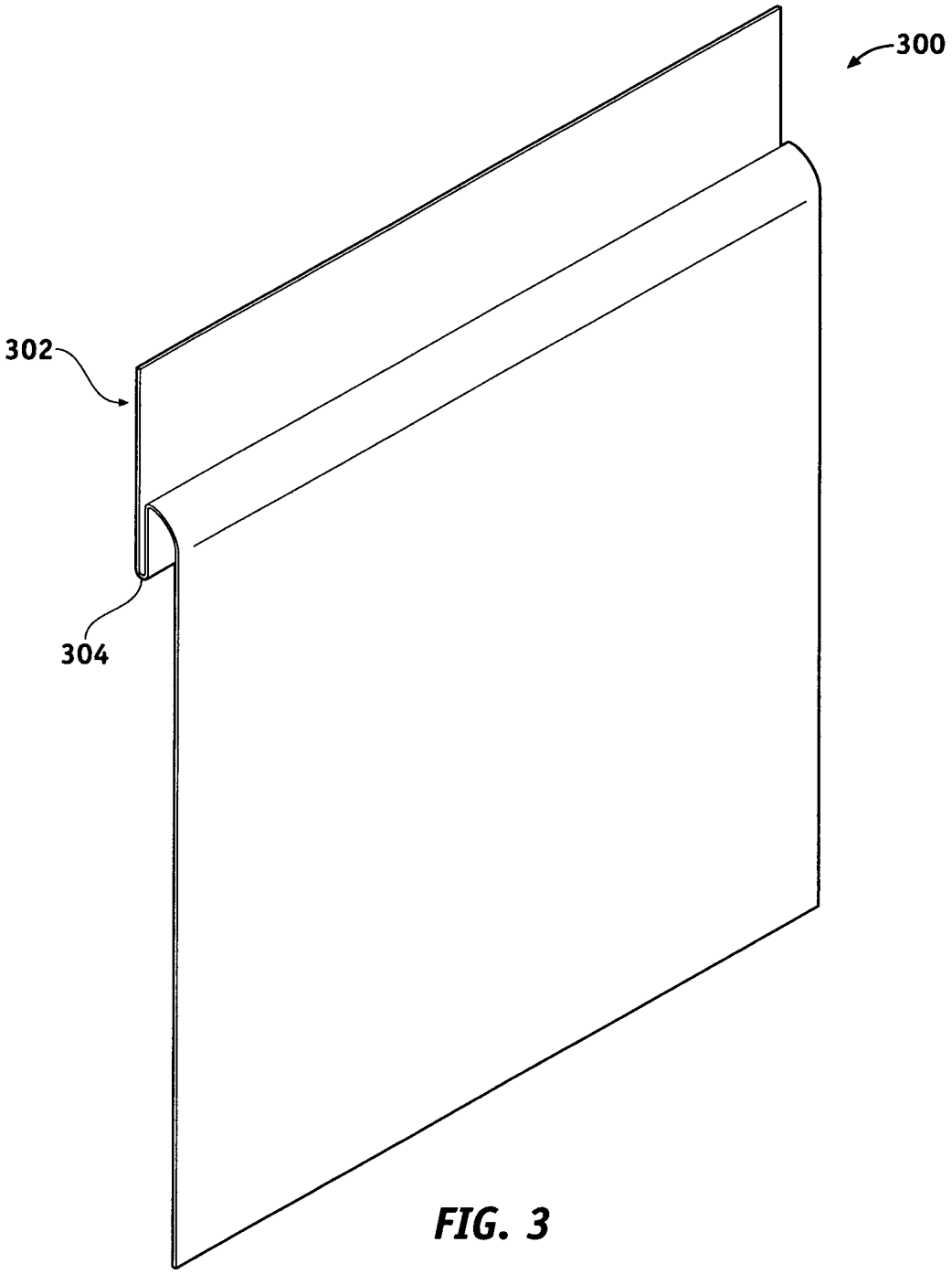
FIG. 3 representatively illustrates another exemplary embodiment of a construction element.

Returning to FIG. 1, construction element 100 may comprise a top flashing 106 comprising a top flashing span 108. Similarly, construction element 100 may comprise a bottom flashing 107 comprising a bottom flashing span 109. Those skilled in the art will understand that spans 108 and 109 may comprise any dimension to adapt to any particular application so as to engage construction element 100 to planar elements 212 and 217, thereby providing a secure barrier to base surface 219. It will be further understood by those skilled in the art that some exemplary embodiments of construction element 100 may comprise a configuration that comprises only one of a leading top edge groove or one of a leading bottom edge groove. For example, FIG. 3 representatively illustrates a construction element 300 that may comprise a leading top edge groove 304 of a leading top edge 302, but in this exemplary embodiment, construction element 300 does not comprise a leading bottom edge groove. Alternately, a construction element may comprise a configuration, though not shown, having only a leading bottom edge groove of a leading bottom edge, but without a leading top edge groove. Furthermore, the flashings, such as top flashing 106 and bottom flashing 107, are shown as substantially planar, but those skilled in the art will understand that such flashings may be bent as a whole or at any point or points along the flashing to accommodate uneven surfaces, provide support/rigidity or even comprise various other non-planar shapes.

Returning again to FIG. 1, construction element 100 is representatively illustrated comprising a width 120, however, it will be understood by those skilled in the art that construction element 100 may be dimensioned to comprise any width to adapt to any particular application. For example, in an embodiment, construction element 100 may comprise of a single width to adapt to a particular span, or, in another embodiment, a plurality of construction elements may be positioned sequentially to cover the span. And among the embodiment that uses sequentially positioned construction elements, the construction elements may be overlapped or butted against one another and joined using a variety of joining technologies, such as, welds, caulks, glues, rivets, etc. In addition, transition construction elements (not shown) may be placed behind the seams of butted construction elements to further act as a barrier.

Figure 4:
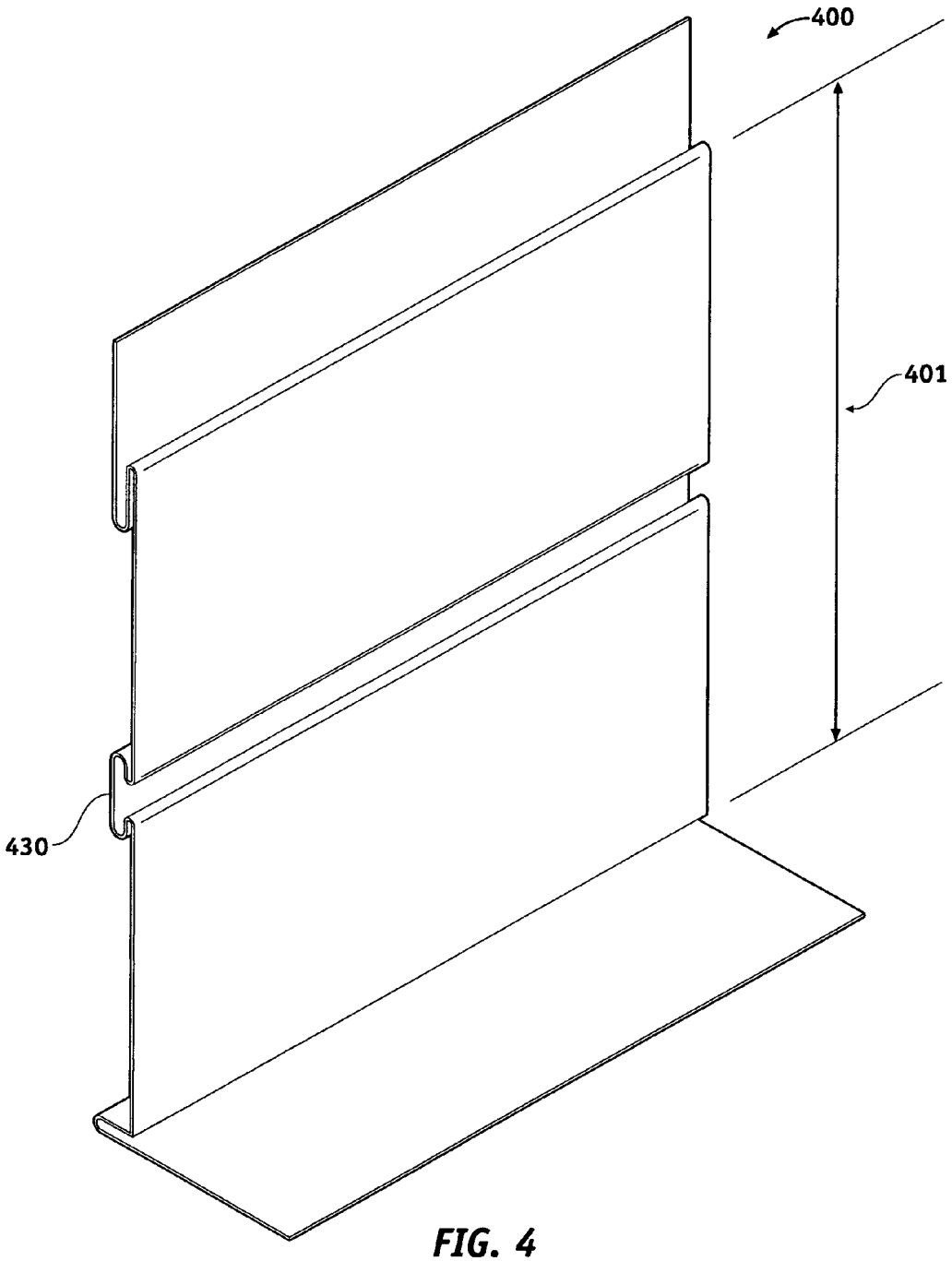
FIG. 4 representatively illustrates yet another exemplary embodiment of a construction element.

Turning now to FIG. 4, an exemplary embodiment of a construction element, construction element 400, may comprise a mid-body groove 430, which on larger spans may aid to support span 401 from flexing, bending, denting, etc. Moreover, mid-body groove 430 may additionally operate to support items (not shown) within mid-body groove 430, such as hooks, utensils, shelving, brackets, papers, or any item that can engage a groove. Construction element 400 is representatively illustrated depicting a single groove 430, but other exemplary embodiments may comprise any number of grooves so as to adapt to a particular application.

Figure 5:
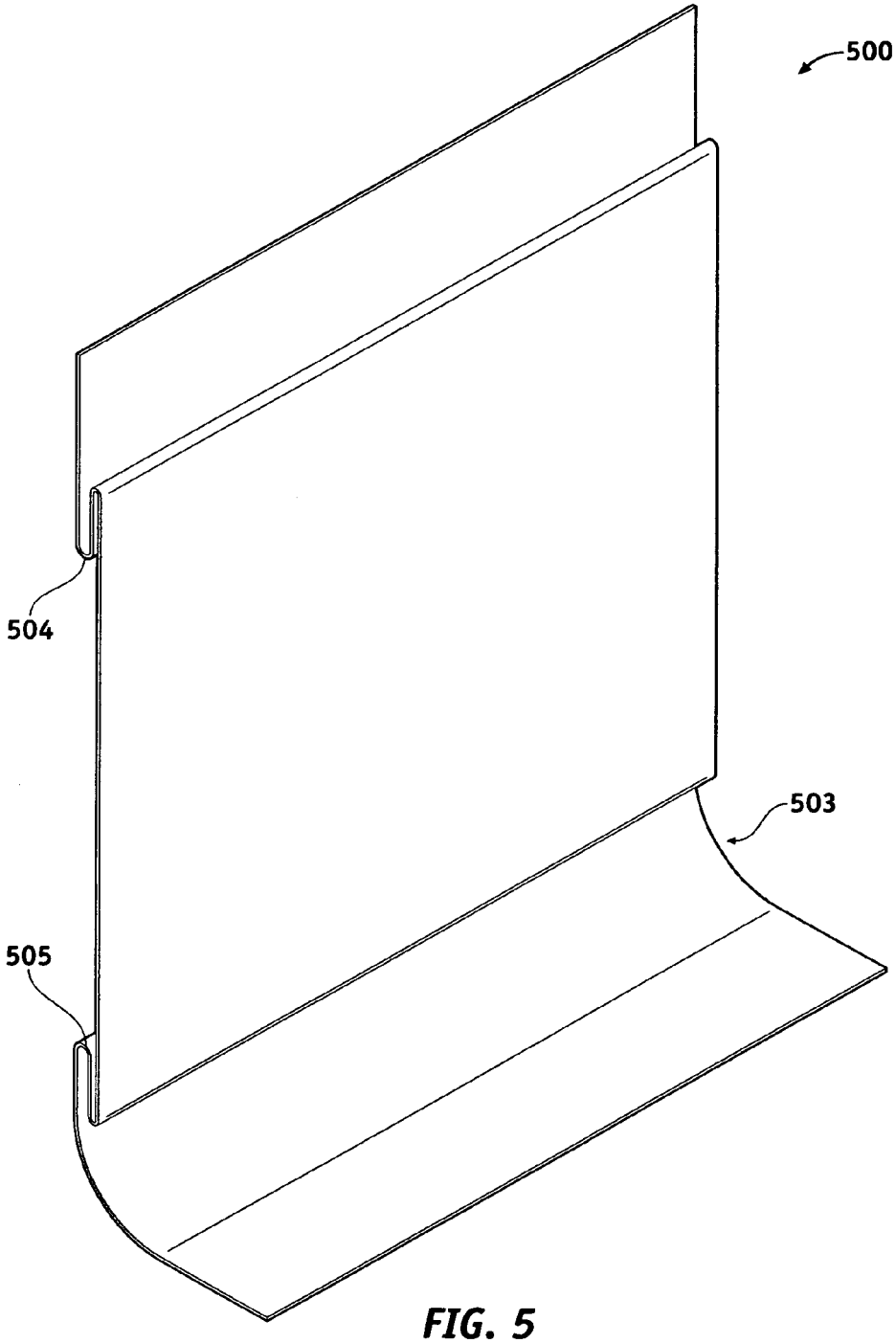
FIG. 5 representatively illustrates still yet another exemplary embodiment of a construction element.

In accordance with an exemplary embodiment of a construction element and with reference to FIG. 5, an alternate construction element 500 comprises a leading bottom edge 503 having an arcuate configuration to, for example, accommodate a flexible planar material, such as, vinyl flooring. Construction element 500 is representatively illustrated showing only leading bottom edge 503 that is arcuate, but other exemplary embodiments may comprise the construction element to comprise both top and bottom leading edges to be arcuate, or construction element 500 may be oriented so that the arcuate leading edge comprises the top portion of construction element 500. It will be further understood by those skilled in the art that either one or both of construction elements' leading edge may comprise other geometric configurations other than planar or arcuate, for example, each leading edge may comprise any regular or irregular configuration so as to accommodate any particular application.

Among various exemplary embodiments of a construction element, a span, such as spans 101 and 401, are depicted as comprising a substantially smooth, planar configuration, but those skilled in the art will understand that the spans may comprise any regular or irregular configuration to accommodate a particular application. For example, instead of being planar, the spans may comprise bends, breaks, a parabolic shape, a domed shape, a concave configuration, etc. Furthermore, the spans may comprise various finishes, such as, a preferable polished finish, but also a textured surface, a patterned surface, an etched surface, etc. Moreover, the spans may be bent, with respect to either one or both of the leading top edges and leading bottom edges to account for any underlying surface anomalies, such as out of plumb, or to accommodate any obstructions, other construction elements, or design requirements.

Among various exemplary embodiments of a construction element, edge grooves, such as edge grooves 104 and 105, are shown in a normal (perpendicular) position, relative to one another. But, as shown in FIG. 5 by grooves 504 and 505, the grooves may be parallel to one another or co-planar. Exemplary embodiments are not limited in this regard, though, and other exemplary embodiments may comprise edge grooves to comprise any acute or obtuse angle between them.

In a preferred embodiment of a construction element, the construction element comprises a stainless steel material configuration. While any material may be used for the construction element and any such material falls within the ambit of this disclosure, stainless steel imparts preferable qualities, such as corrosion resistance, strength, ease of cleaning, etc.

Figure 6:
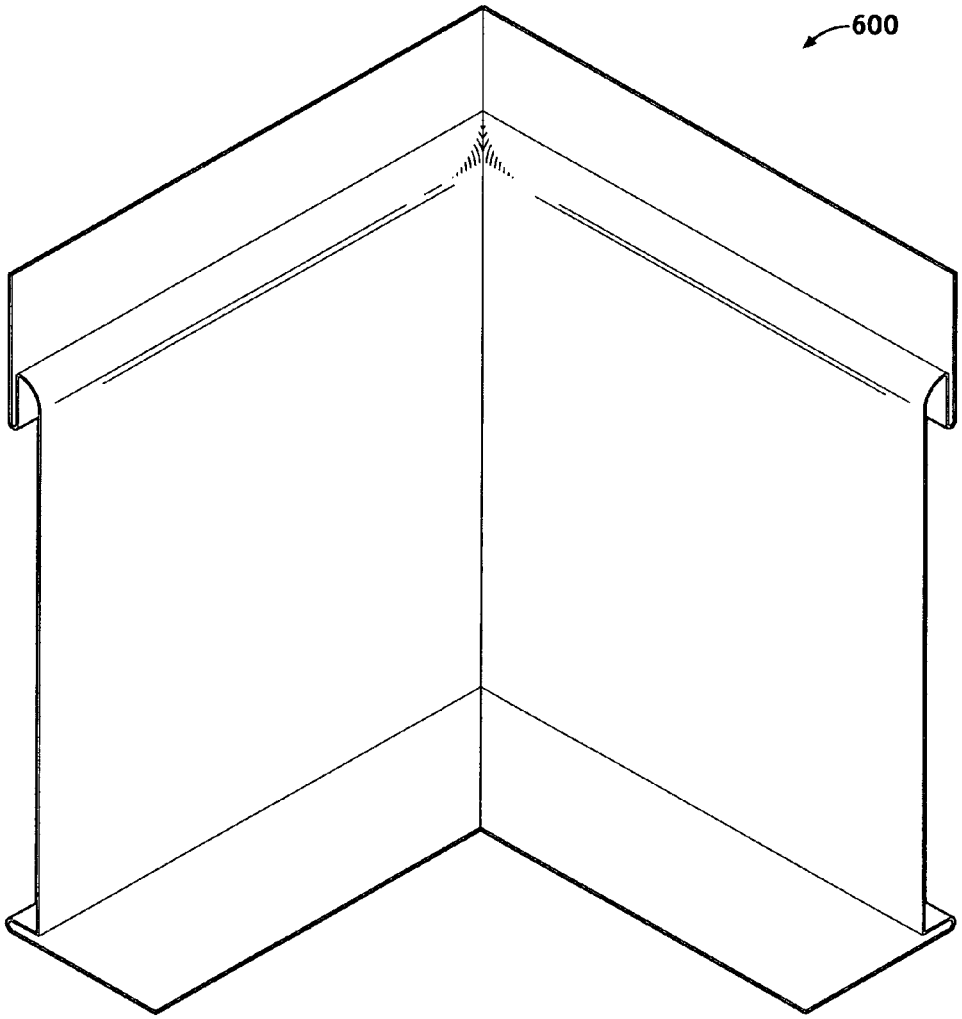
FIG. 6 representatively illustrates an inside corner configuration of an exemplary embodiment of the construction element.
Figure 7:
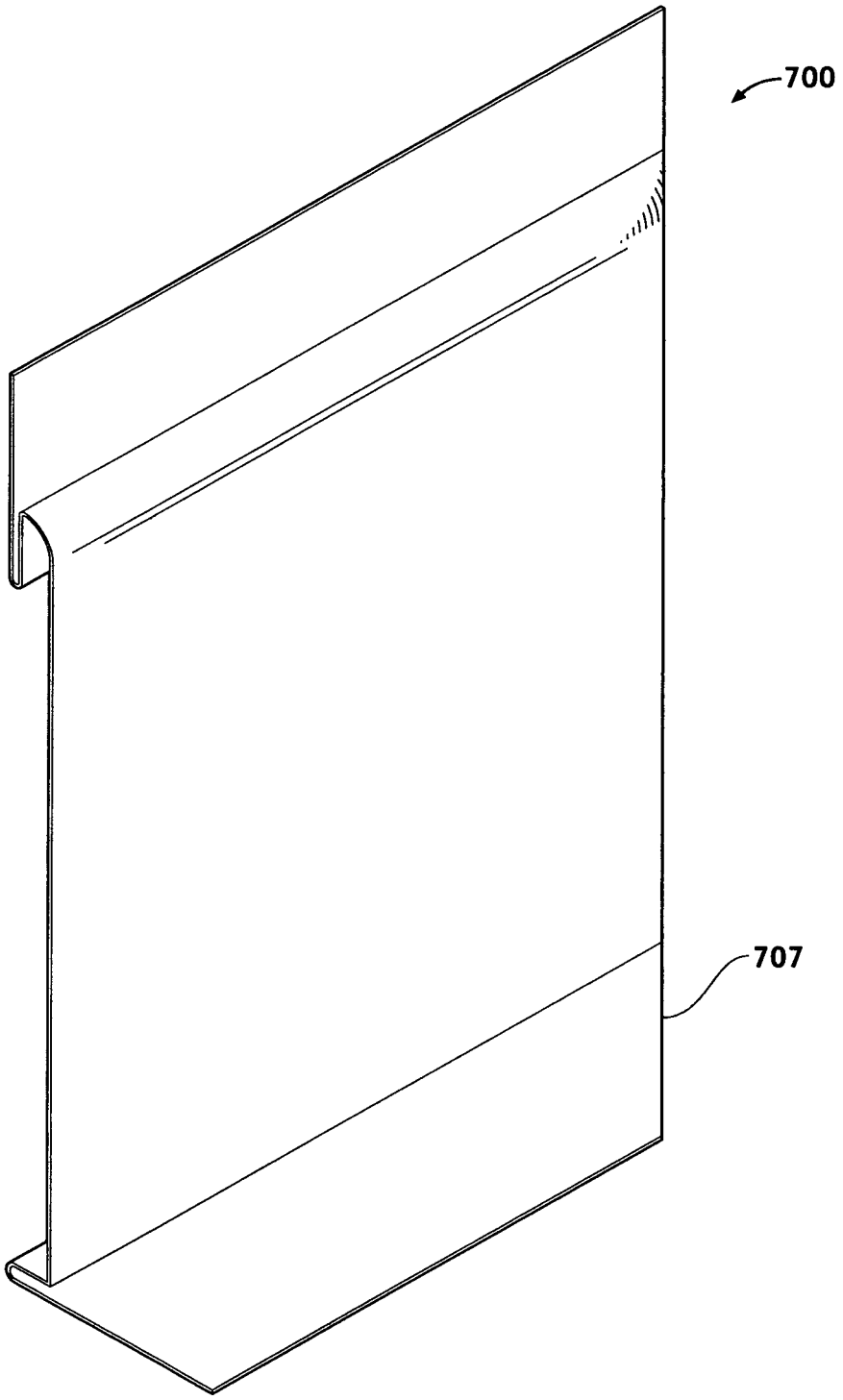
FIG. 7 representatively illustrates an exemplary embodiment of the construction element depicting an angled flashing.

In accordance with various exemplary embodiments, construction elements, such as construction elements 100, 300, 400, and/or 500, may comprise a configuration that accommodates various construction specifications. For example, FIG. 6 representatively illustrates construction element 600, which is configured to accommodate an inside corner. In such an embodiment, two construction elements may be butted up against one another and the flashings, similar to flashing 107 of FIG. 1, may be configured at an angle to allow the two construction elements to align tightly. An example of a construction element comprising an angled flashing is representatively illustrated in FIG. 7. In this exemplary embodiment, construction element 700 comprises angled flashing 707.

Figure 8:
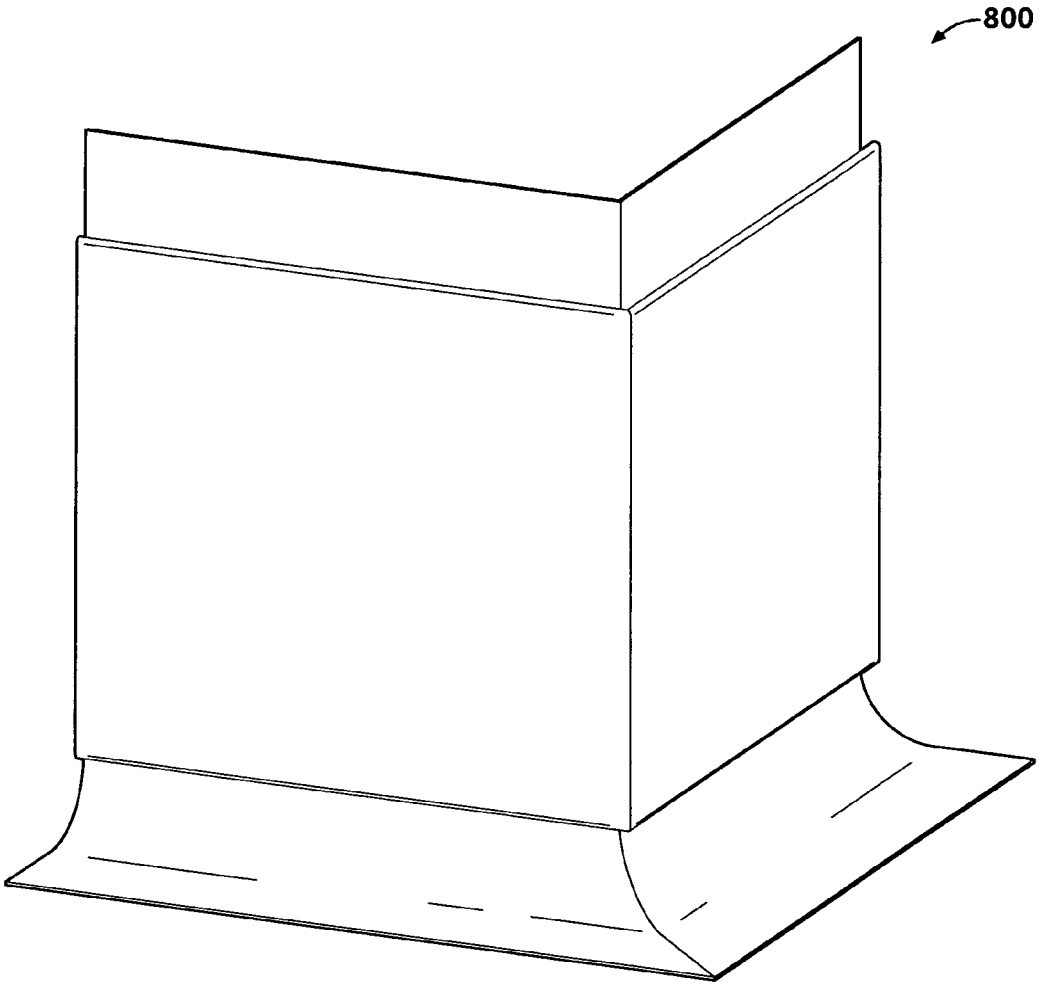
FIG. 8 representatively illustrates an outside corner configuration of an exemplary embodiment of the construction.

In somewhat similar fashion, FIG. 8 representatively illustrates construction element 800 configured to accommodate an outside corner. In such an embodiment, two construction elements may again be butted up against one another and the flashings, similar to flashing 107 of FIG. 1, may be configured at an angle to allow the two construction elements to align tightly. Those skilled in the art will further understand that instead of using two construction elements butted up against one another to create an inside or outside construction element, a single piece may be manufactured for such specific applications. Moreover, it will be understood by those skilled in the art that the construction element is not limited in this inside-corner, outside-corner regard, and that construction elements may be configured to accommodate any variety of acute or obtuse angles so that they may be appropriately used for such angled surfaces. It will also be understood that the construction element may be configured to accommodate various irregular or regular geometric shapes such as hexagons, octagons, etc., as well as rounded, oval shapes or any other curved surface.

Figure 9:
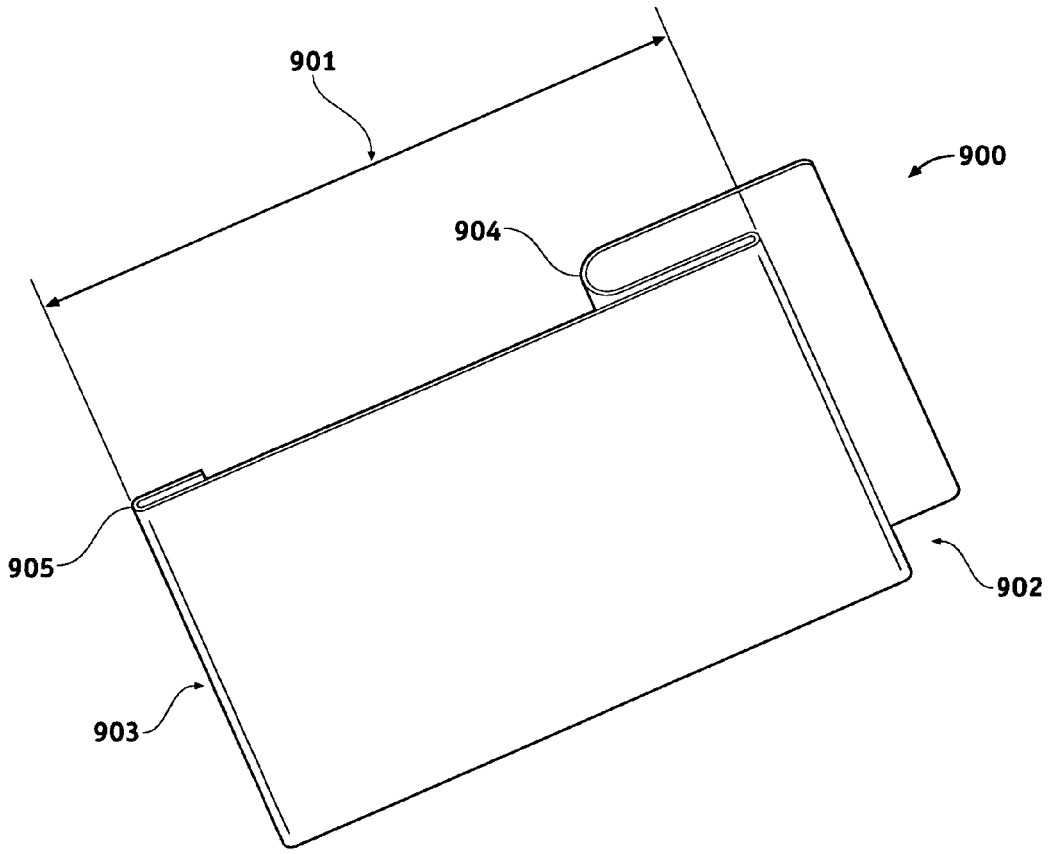
FIG. 9 representatively illustrates another exemplary embodiment of the construction element.
Figure 10:
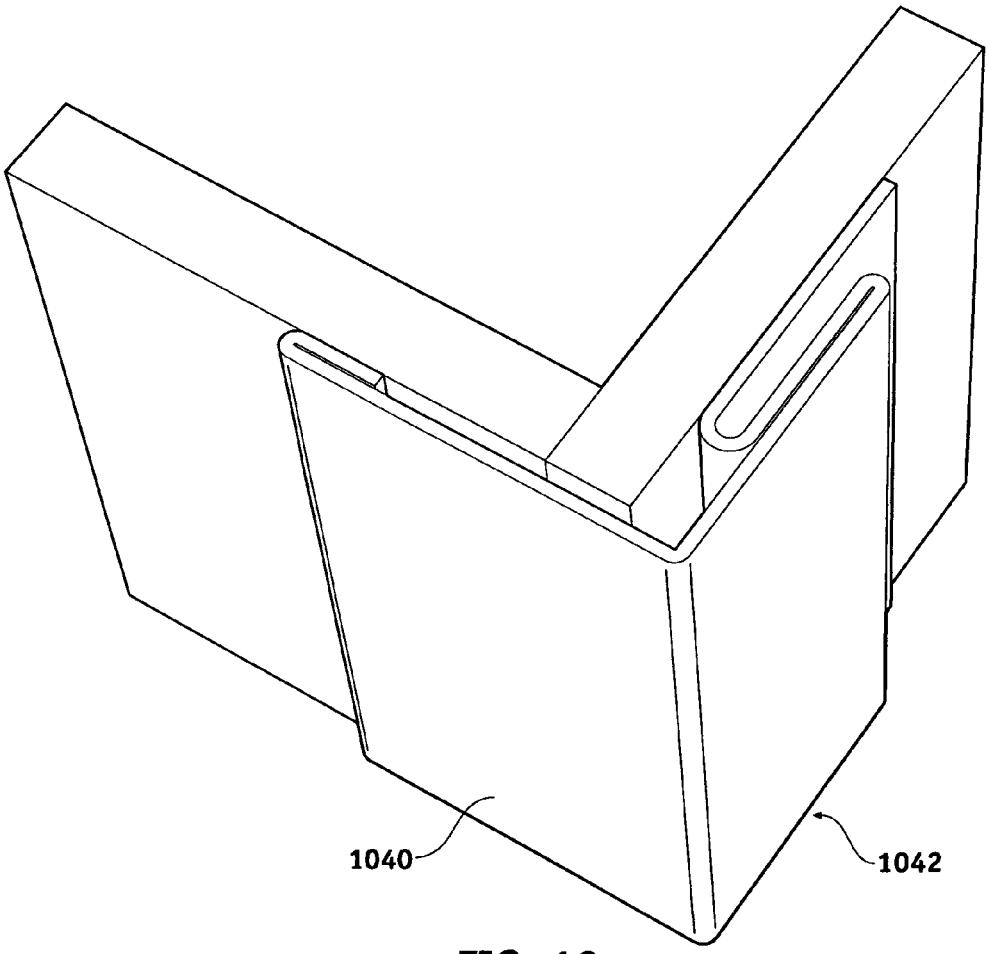
FIG. 10 representatively illustrates the exemplary embodiment as used in an outside corner configuration.
Figure 11:
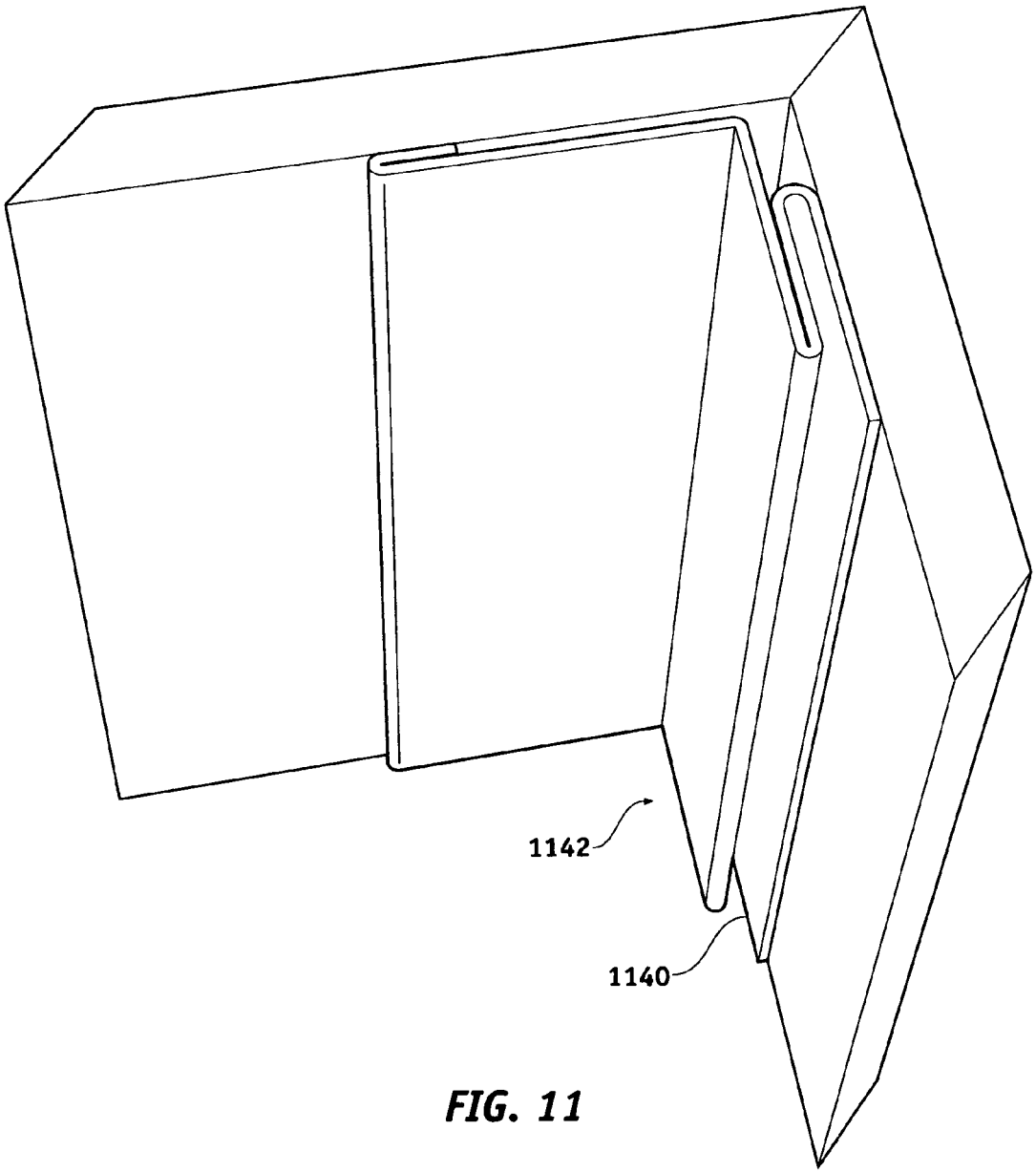
FIG. 11 representatively illustrates the exemplary embodiment as used in an inside corner configuration.
Figure 12:
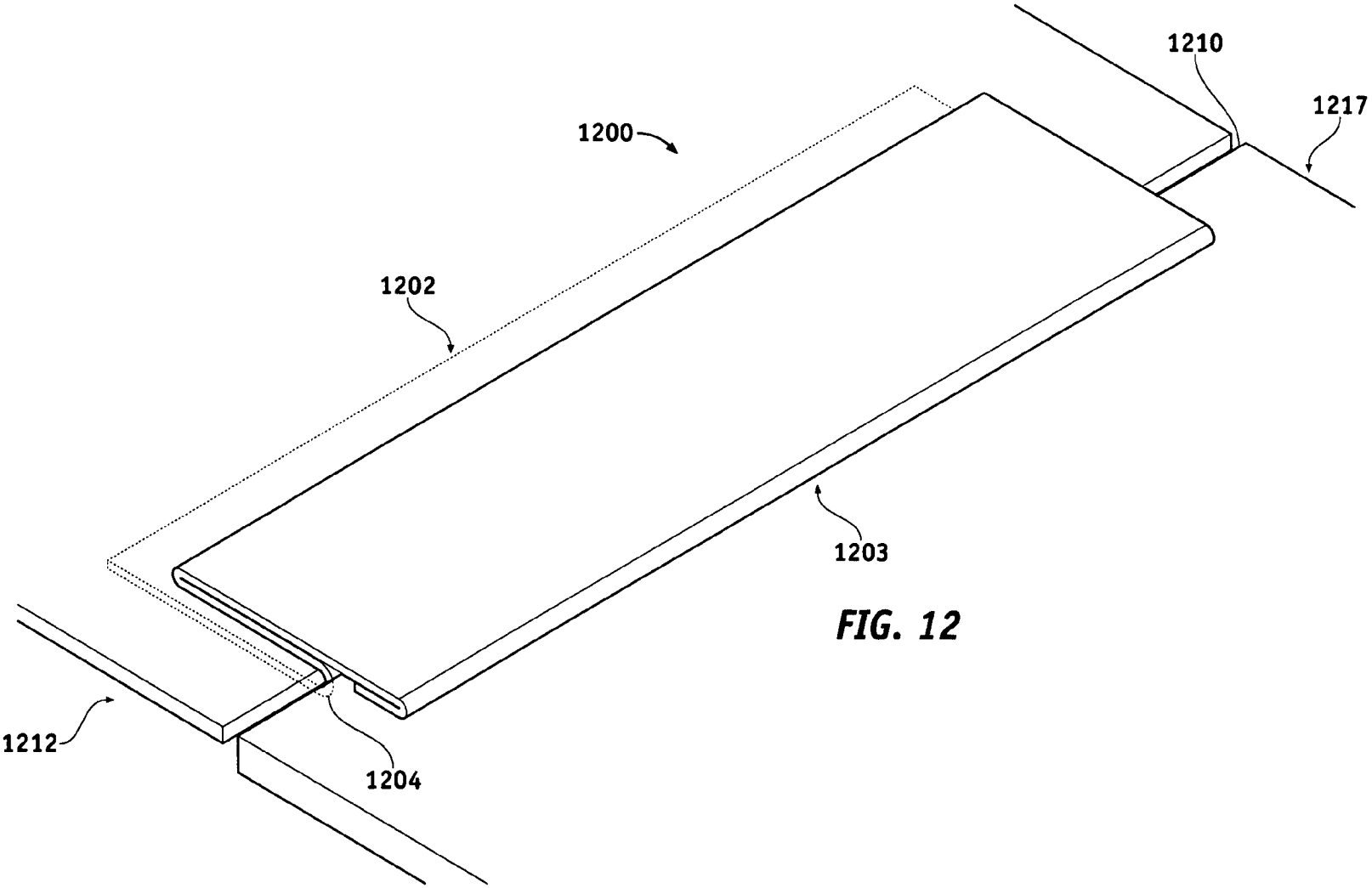
FIG. 12 representatively illustrates the exemplary embodiment as used in a transition configuration.

In accordance with various exemplary embodiments, a construction element may be configured to operate as a finishing trim element. For example, and with reference to FIG. 9, finishing element 900 may comprise a span 901 of continuous sheet material having a first edge portion 902 folded back upon itself in an "S" shaped pattern to form an integrated first edge portion groove 904 to accept an edge of a planar material (not shown) within first edge portion groove 904. Finishing trim element 900 may further comprise a leading second edge portion 903, opposite first edge portion 902, folded back upon it to form a bull nosed configuration 905. Finishing trim element 902 is very similar to construction element 300, FIG. 3, but in this exemplary embodiment, leading second edge portion 903 comprises a bull nosed configuration. It will be understood by those skilled in the art that the basic configuration of finishing trim element 900 may be manipulated, i.e. bent, in a variety of fashions so as to operate as a finishing trim element in a variety of applications. For example, and with reference to FIG. 10, a finishing trim element, similar to trim element 900, may be bent along a mid-line 1040 so as to create a finishing trim element 1042 that may accommodate an outside corner. Similarly, and with reference to FIG. 11, a trim element, similar to trim element 900, may be bent along a mid-line 1140 so as to create a finishing trim element 1142 that may accommodate an inside corner. In still yet another embodiment, a finishing trim element may not be bent in any fashion, and may be used as a transition from one finishing surface to another, as representatively illustrated by FIG. 12. In this embodiment, trim element 1200 comprises a first edge portion 1202 comprising a first edge portion groove 1204, which can receive an edge 1210 of a first planar material 1212; a second edge portion 1203 is positioned over a second planar material 1217 to complete the transition.

Figure 13:
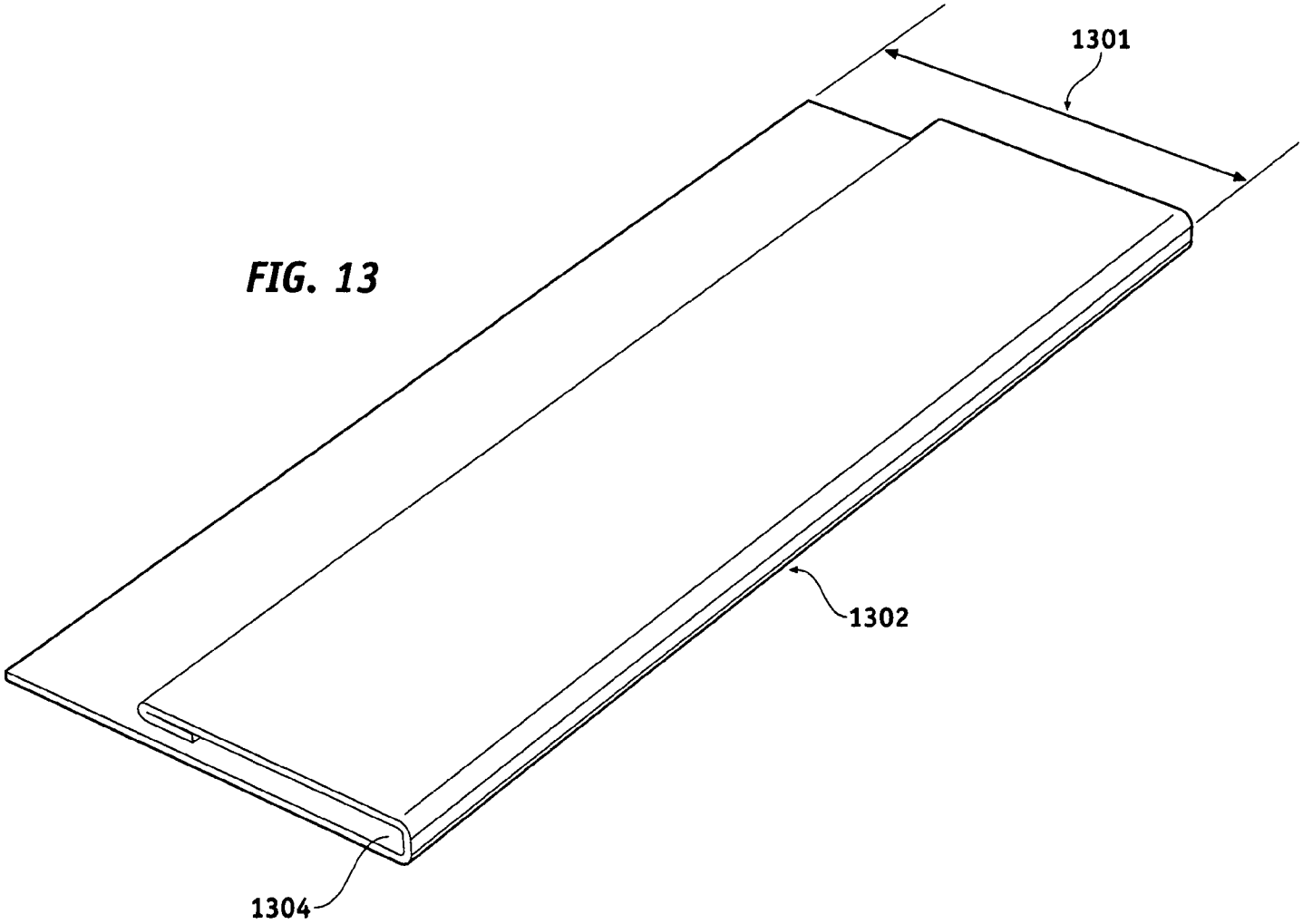
FIG. 13 representatively illustrates another exemplary embodiment of a construction element.
Figure 14:
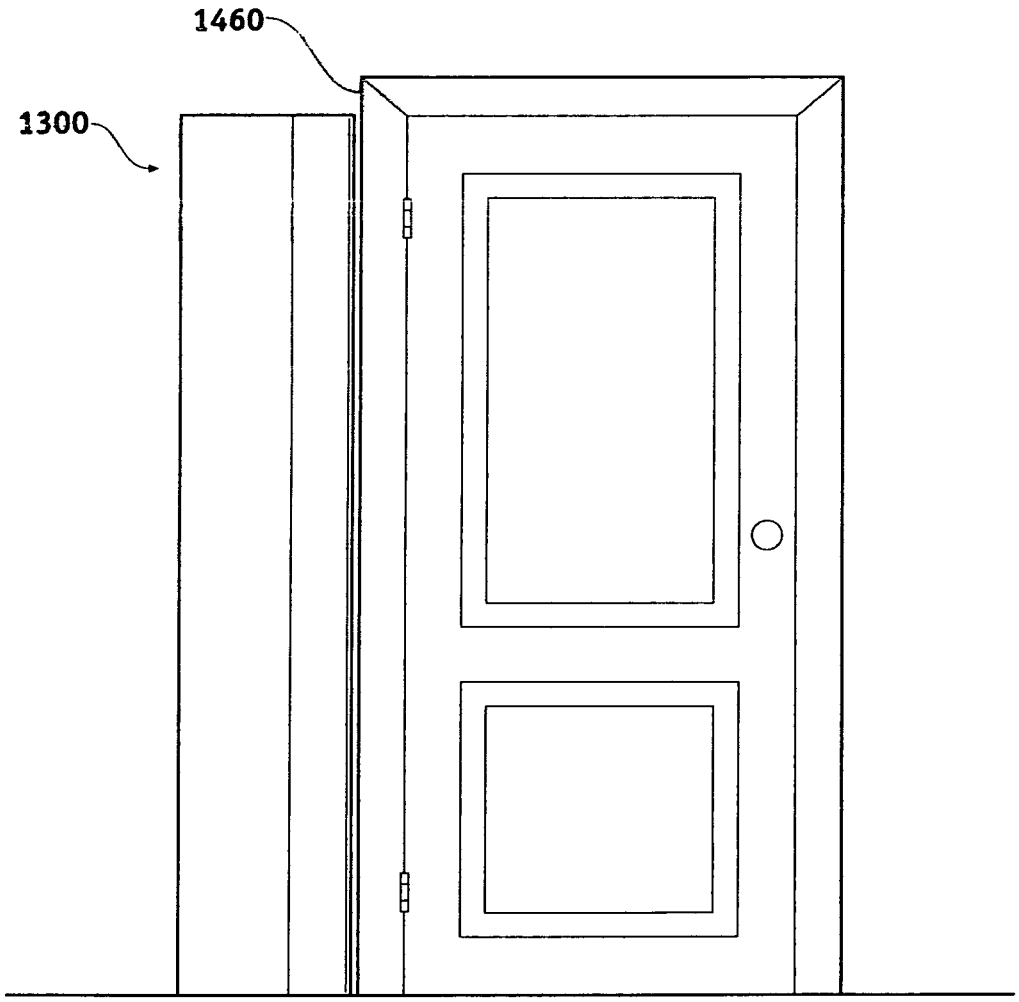
FIG. 14 representatively illustrates the exemplary embodiment of the construction element as used in a particular environment.

In accordance with still another exemplary embodiment, and with reference to FIGS. 13 and 14, in the most simplest form a construction element 1300 may comprise a span 1301 and a first leading edge 1302 comprising, in a "U" shaped fashion, first leading edge groove 1304. This configuration is suitable as a termination type finishing element and best demonstrated by FIG. 14. In this example, construction element 1300 may be installed adjacent other finishing trim, such as doorway trim 1460.

Among the various exemplary embodiments disclosed, it is evident that the configuration of the construction element lends itself to comprise various advantages over currently used construction elements. For example, other construction elements are generally mounted flush to an underlying surface. The herein disclosed construction elements, though, comprise a configuration when installed that may result in a gap between the construction element's span and the underlying surface. This may beneficially allow for ambient air to flow freely behind the construction element, thereby deterring any stagnant environment that might promote the growth of bacteria, mold, odors, etc. Moreover, and as can be seen best by FIG. 2, other construction elements, such as a conduit, like conduit 280, maybe positioned behind the construction element, thereby concealing it without any bulges, bends, creases, and the like to the construction element's span surface.

Among the various exemplary embodiments disclosed herein, those skilled in the art will understand that the specific configurations of construction elements discussed, such as spans, leading edges, leading edge grooves, etc., are not limited in such specific regard. For example, a construction element may comprise any number and/or combination or permutation of configurations discussed, such as grooves, bull nosed folds, S-Shaped folds, U-shaped folds, bends, breaks, hems, and the like, or none at all.

In accordance with an exemplary method of a construction element, a user may assemble a barrier for a surface by providing a construction element comprising a span of continuous sheet material, preferably stainless steel, comprising a leading top edge folded back upon itself in a fashion to form an integrated leading top edge groove to accept an edge of a first planar material within the leading top edge groove. In accordance with this exemplary method, the construction element may further comprise a leading bottom edge folded back upon itself in a fashion to form an integrated leading bottom edge groove to accept an edge of a second planar material within the leading bottom edge groove. The user may then assemble; the construction element, the first planar material, and the second planar material to comprise a continuous barrier for the surface, for example, at least one of a wall and a floor.

Among various exemplary embodiments, a span of continuous sheet material may be dimensioned to operate as at least one of a baseboard trim construction element, a crown molding construction element, and a wainscoting construction element. Moreover, a leading top edge groove and a leading bottom edge groove may be comprised to form grooves that are; substantially co-planar to one another, substantially normal to one another, and any other obtuse or acute angle. Additionally, a construction element may comprise a formed mid-body groove to support the span of the sheet material from flexing, and a construction element may be folded at a leading top, bottom or any other perimeter edge, to comprise an "S" shape, a "U" shape, a bull-nosed shape configuration, or not folded at all.

In the foregoing specification, construction elements have been described with reference to a number of exemplary embodiments. Various modifications and changes may be made, however, without departing from the scope of the construction element as set forth in the claims. The specification and figures are illustrative, rather than restrictive, and modifications are intended to be included within the scope of any construction element. Accordingly, the scope of any construction element should be determined by the claims and their legal equivalents rather than by merely the exemplary embodiments described.

For example, the steps recited in any method or process claims may be executed in any order and are not limited to the specific order presented in the claims. Additionally, the components and/or elements recited in any physical embodiment claims may be assembled or otherwise operationally configured in a variety of permutations and are accordingly not limited to the specific configuration recited in the claims.

Benefits, other advantages and solutions to problems have been described above with regard to particular embodiments; however, any benefit, advantage, solution to problem or any element that may cause any particular benefit, advantage or solution to occur or to become more pronounced are not to be construed as critical, required or essential features or components of any or all the claims.

As used herein, the terms "comprise", "comprises", "comprising", "having", "including", "includes", "is" or any variation thereof, are intended to reference a non-exclusive inclusion, such that a process, method, article, composition, system, device, or apparatus that comprises a list of elements does not include only those elements recited, but may also include other elements not expressly listed or inherent to such process, method, article, composition, system, device, or apparatus. Other combinations and/or modifications of the above-described structures, arrangements, applications, proportions, elements, materials or components used in the practice of a construction element, in addition to those not specifically recited, may be varied or otherwise particularly adapted to specific environments, manufacturing specifications, design parameters or other operating requirements without departing from the general principles of the same.

We claim:

1. A construction element comprising:

a span of continuous sheet material comprising:

a top edge folded back upon itself in a fashion to form a top edge groove to accept an edge of a first planar material within the top edge groove, the top edge groove comprises:

a first bend at a first end of the top edge groove;

a second bend at a bottom of the top edge groove;

a first side of the top edge groove located between the first bend and the second bend and parallel to the span of continuous sheet material; and a second side of the top edge groove located after the second bend, the second side is parallel to the span of continuous sheet material and extends past the first bend;

one or more body grooves, wherein each of the one or more body grooves comprise:

a first body bend;

a second body bend; and a body side located between the first body bend and the second body bend, wherein the body side is parallel to the span of continuous sheet material and is co-planar with the second side of the top edge groove; and a bottom edge folded in a fashion to form a bottom edge groove to accept an edge of a second planar material within the bottom edge groove, the bottom edge groove comprises:

a third bend at a first point of the bottom edge groove;

a fourth bend at a second point of the bottom edge groove; and a first side of the bottom edge groove located between the third bend and the fourth bend and perpendicular to the span of continuous sheet material.

2. The construction element of claim 1, wherein:
the first bend at the first end of the top edge groove forms the top edge such that the second bend at the bottom of the top edge groove is behind a front of the construction element; and
the third bend at the first point of the bottom edge groove forms the bottom edge such that the fourth bend at the second point of the bottom edge groove is behind the front of the construction element.

3. The construction element of claim 1, further comprising:
a first portion of the span of continuous sheet material located between the one or more body grooves and the top edge; and
a second portion of the span of continuous sheet material located between the one or more body grooves and the bottom edge, the second portion of the span of continuous sheet material is coplanar with the first portion of the span of continuous sheet material.

4. The construction element of claim 1, wherein:
a top edge groove opening of the top edge groove faces a direction perpendicular to a bottom edge groove opening of the bottom edge groove.

5. The construction element of claim 1, further comprising:
a second side of the bottom edge groove located after the fourth bend, the second side of the bottom edge groove is parallel to the first side of the bottom edge groove, extends past the third bend, and is perpendicular to the span of continuous sheet material;
wherein:
the second side of the top edge groove extends past the first bend such that the top edge groove is accessible from a front of the construction element; and
the second side of the bottom edge groove extends past the third bend such that the bottom edge groove is accessible from the front of the construction element.

6. The construction element of claim 1, wherein:
the construction element is a baseboard.

7. The construction element of claim 1, wherein:
at least one of the one or more body grooves is configured to support one or more items within the at least one of the one or more body grooves.

8. The construction element of claim 7, wherein:
the one or more items comprise at least one of:
a hook;
a utensil;
a shelf;
a bracket; or
a paper.

9. The construction element of claim 1, wherein:
the span of continuous sheet material comprises at least one of:
stainless steel;
steel;
aluminum;
copper;
a vinyl; or
an alloy.

10. The construction element of claim 1, wherein:
the edge of the first planar material accepted within the top edge groove is secured within the top edge groove by at least one of:
friction;
a glue;
a weld;
a caulk;
a rivet;
a screw; or
a bolt.

11. The construction element of claim 1, wherein:
the edge of the second planar material accepted within the bottom edge groove is secured within the bottom edge groove by at least one of:
friction;
a glue;
a weld;
a caulk;
a rivet;
a screw; or
a bolt.

12. The construction element of claim 1, wherein:
at least one of the one or more body grooves is configured to aide in supporting the span of continuous sheet material from flexing.

13. The construction element of claim 1, wherein:
the span of continuous sheet material comprises at least one of:
a polished finish;
a textured finish;
a patterned surface; or
an etched surface.

14. The construction element of claim 1, wherein:
the span of continuous sheet material is concave.

15. The construction element of claim 1, wherein:
the construction element is a crown molding.

16. The construction element of claim 1, wherein:
the construction element is a wainscoting.

17. The construction element of claim 1, wherein:
the construction element is a backsplash.

18. The construction element of claim 1, wherein:
the span of continuous sheet material comprises a dimension of approximately a few inches; and
the dimension is measured from the bottom edge to the top edge.

19. The construction element of claim 1, wherein:
the span of continuous sheet material comprises a dimension of approximately a several feet; and
the dimension is measured from the bottom edge to the top edge.

* * * * *